US008113999B2

(12) United States Patent
Falter

(10) Patent No.: US 8,113,999 B2
(45) Date of Patent: Feb. 14, 2012

(54) TRAINING HOOP

(76) Inventor: Stephen Falter, Rochester, NY (US)

( * ) Notice: Subject to any disclaimer, the term of this patent is extended or adjusted under 35 U.S.C. 154(b) by 1090 days.

(21) Appl. No.: 11/959,843

(22) Filed: Dec. 19, 2007

(65) Prior Publication Data

US 2009/0001703 A1 Jan. 1, 2009

Related U.S. Application Data

(63) Continuation-in-part of application No. 11/279,023, filed on Apr. 7, 2006, now abandoned.

(60) Provisional application No. 60/968,719, filed on Aug. 29, 2007, provisional application No. 60/728,943, filed on Oct. 17, 2005, provisional application No. 60/670,321, filed on Apr. 12, 2005.

(51) Int. Cl.
*A63B 23/00* (2006.01)
*A47B 1/00* (2006.01)

(52) U.S. Cl. ..... 482/148; 5/627

(58) Field of Classification Search ..... 434/253–255; 482/51, 71, 78, 139, 66–67, 143, 907, 91; 5/114, 627

See application file for complete search history.

(56) References Cited

U.S. PATENT DOCUMENTS

| | | | | | |
|---|---|---|---|---|---|
| 2,108,566 | A * | 2/1938 | Sanders | 482/69 |
| 2,545,009 | A * | 3/1951 | Spiteri | 482/51 |
| 2,956,616 | A * | 10/1960 | Henry | 482/69 |
| 3,237,939 | A * | 3/1966 | Olivet et al. | 482/69 |
| 3,779,201 | A * | 12/1973 | Spahn | 441/66 |
| 4,679,260 | A * | 7/1987 | Frettem | 5/627 |
| 4,922,860 | A * | 5/1990 | Hutchings | 482/69 |
| D320,054 | S * | 9/1991 | Yanazaki | D21/692 |
| 5,074,795 | A * | 12/1991 | Clark | 434/253 |
| 5,080,191 | A * | 1/1992 | Sanchez | 182/3 |
| 5,141,441 | A * | 8/1992 | Wallingford | 434/254 |
| 5,725,463 | A * | 3/1998 | Colonello et al. | 482/140 |
| 5,791,906 | A * | 8/1998 | Robinson, Jr. | 434/255 |
| 6,019,608 | A * | 2/2000 | Stark | 434/253 |
| 6,135,931 | A * | 10/2000 | Padula et al. | 482/74 |
| 6,196,949 | B1 * | 3/2001 | Rodarte | 482/69 |
| 6,203,473 | B1 * | 3/2001 | Atwood | 482/95 |
| 6,361,478 | B1 * | 3/2002 | Giancaspro | 482/69 |
| 6,432,029 | B1 * | 8/2002 | Almeda | 482/140 |
| 6,592,377 | B2 * | 7/2003 | Bendele, Jr. | 434/253 |
| 6,681,424 | B1 * | 1/2004 | Bourgraf et al. | 5/611 |
| 6,758,793 | B2 * | 7/2004 | Eldridge | 482/77 |
| 7,199,311 | B1 * | 4/2007 | Buckner et al. | 177/144 |
| 7,357,761 | B2 * | 4/2008 | Mattox | 482/125 |
| 2006/0110716 | A1 * | 5/2006 | Micari et al. | 434/253 |
| 2009/0222988 | A1 * | 9/2009 | Reed et al. | 5/627 |

* cited by examiner

*Primary Examiner* — Stephen Crow
(74) *Attorney, Agent, or Firm* — Eugene S. Stephens, PC

(57) ABSTRACT

An oblong hoop formed of six tube pieces fitted together end to end has tube junctions at each of four beveled corners. A pair of telescoping side junctions preferably connects side tubes together to make the oblong hoop extendable and retractable in length. The hoop can be used in three ways during three stages of learning—first, with the pupil supported in the front region of the hoop and an instructor within the hoop and close behind the pupil, second, with the pupil remaining forward in the hoop and the instructor moving to a rear region of the hoop, and third, with the pupil remaining in the forward region of the hoop, and the instructor moving outside the hoop to hold onto a rear region of the hoop.

8 Claims, 6 Drawing Sheets

TRAINING HOOP

REFERENCE TO RELATED APPLICATIONS

This application claims an invention which was disclosed in Provisional Application No. 60/968,719, filed 29 Aug. 2007, entitled Training Hoop. The benefit under 35 USC §119(e) of the United States provisional application is hereby claimed, and the aforementioned application is incorporated herein by reference.

This application is also a continuation-in-part of U.S. patent application Ser. No. 11/279,023, filed 7 Apr. 2006, entitled "Ski Training Device", (abandoned upon the filing of this application), which claims one or more inventions which were disclosed in provisional application No. 60/670,321 filed 12 Apr. 2005, entitled "Do-Ski"; and provisional application No. 60/728,943, filed 17 Oct. 2005, entitled "Ski-Pal: Safety Ski and Snowboard Training Hoop". The benefit under 35 USC §119(e) of the United States provisional application is hereby claimed, and the aforementioned applications are incorporated herein by reference.

FIELD OF THE INVENTION

Training devices for skiing, snowboarding, and skating.

BACKGROUND

Harnesses, straps, handholds, and hula hoops have been used to help beginners stay on their feet as they learn to ski, snow board, or skate. These devices have suffered various problems including inadequate functioning, inconvenience, cumbersomeness, and expense, so that none of them have been very successful in the marketplace.

SUMMARY

A goal of this invention is to remedy the shortcomings of previous suggestions for training devices for beginning skiers, snowboarders, and skaters. In doing so, the invention aims at effectiveness, convenience, and low cost in a training device that allows several modes of use and helps make the learning experience pleasant for instructor and trainee.

The inventive trainer assembles of tubing pieces to form an oblong hoop with tube junctions at each corner, and telescoping tube junctions on each side. The hoop can be knocked down into six transportable pieces that can be carried in a small and compact bag. When assembled and held together, preferably with push pin couplings that lock tube ends together, the oblong hoop can extend across the chest and under the armpits or at waist level of a pupil positioned in a forward region. In a first stage of learning, an instructor is also inside the hoop closely behind the pupil to hold and manipulate the hoop and the pupil. This provides good support for a pupil who is beginning to learn the feel of skiing or skating. At a second stage of more advance learning, the instructor can move to a rear region of the hoop while remaining within the hoop to help control and guide the pupil. For this purpose, the hoop is preferably extendable with the aid of telescoping joints in its side tubes. At a more advanced learning stage, the pupil remains within the forward region of the hoop while the instructor follows outside the hoop hanging onto the rear region of the hoop to help control and guide the pupil. For snow boarding or skate boarding the instructor and pupil can hold onto opposite sides of the oblong hoop while facing each other. The instructor's strength in holding one side of the hoop provides support and leverage for the pupil holding the other side of the hoop while learning the maneuvers that can prevent falling.

DRAWINGS

Figure 3:
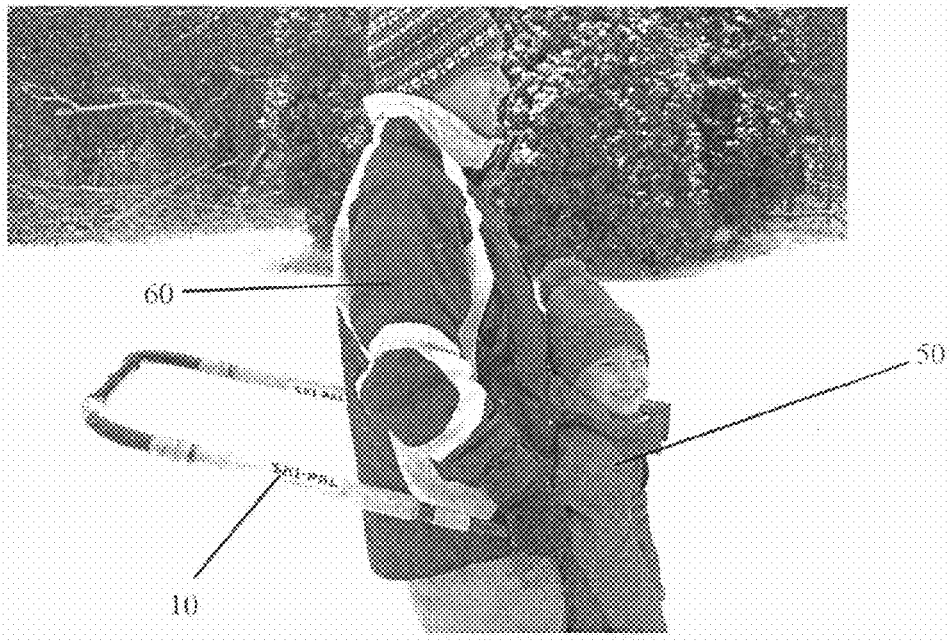
Figure 4:
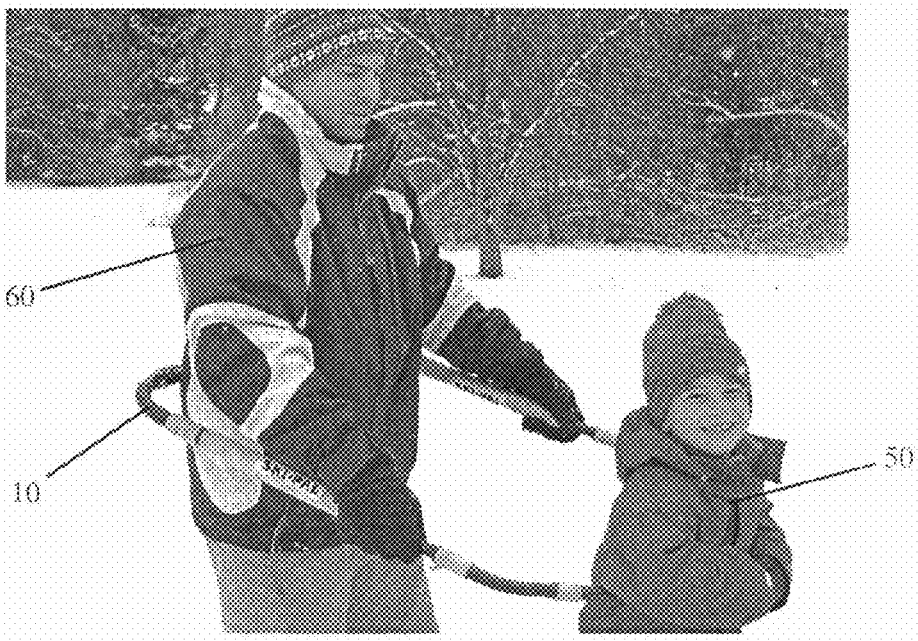
Figure 5:
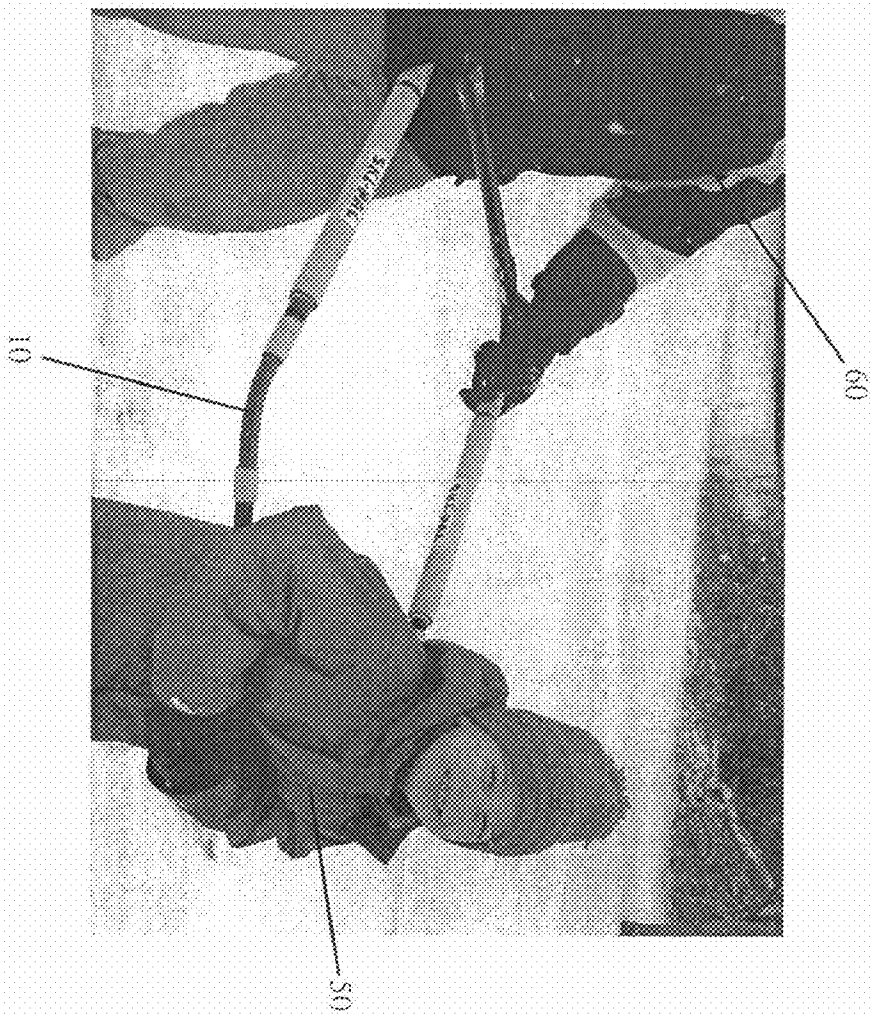

FIGS. 3, 4, and 5 are views of use of the training hoop respectively for a first stage of learning in FIG. 3, a second stage of learning in FIG. 4, and a third stage of learning in FIG. 5.

Figure 6:
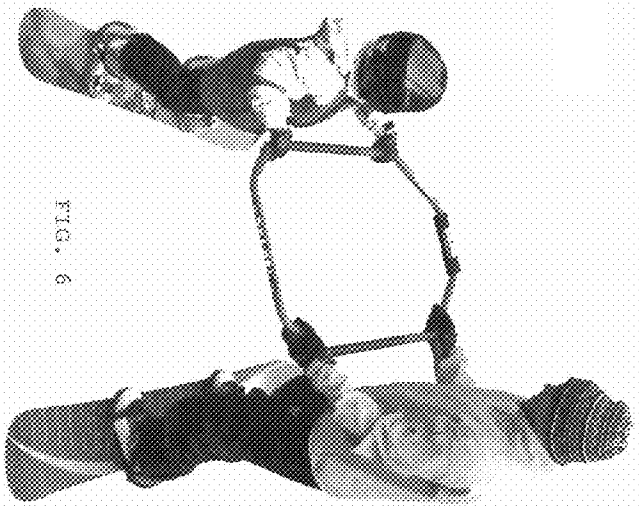

FIG. 6 illustrates use of the training hoop for snowboarding instruction.

Figure 7:
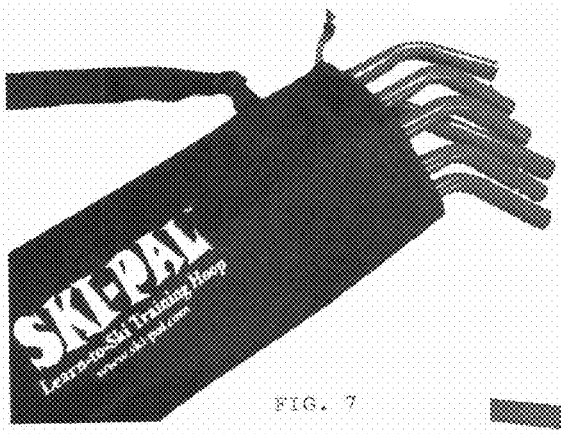

FIG. 7 is a fragmentary view showing how parts of the training hoop can be stored in a compact bag.

Figure 8:
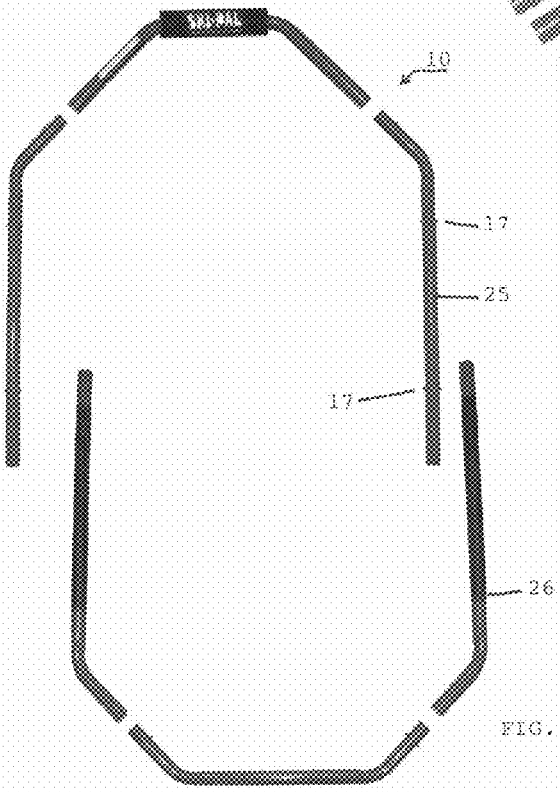

FIG. 8 is a view showing separation of the hoop parts juxtaposed near their assembly positions.

Figure 9:
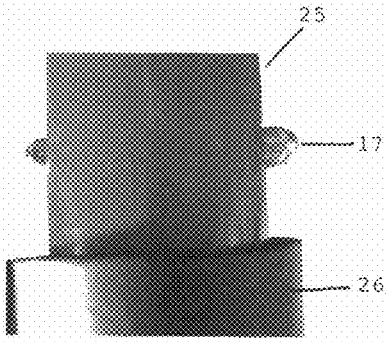

FIG. 9 is an enlarged fragmentary view of a push pin on a tube end telescopically entering another tube, for assembly.

Figure 10:
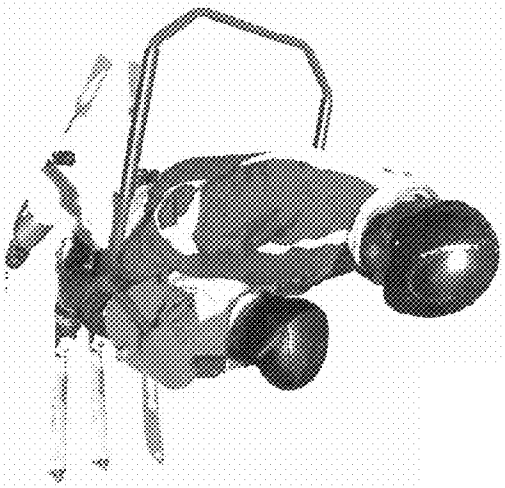
Figure 11:
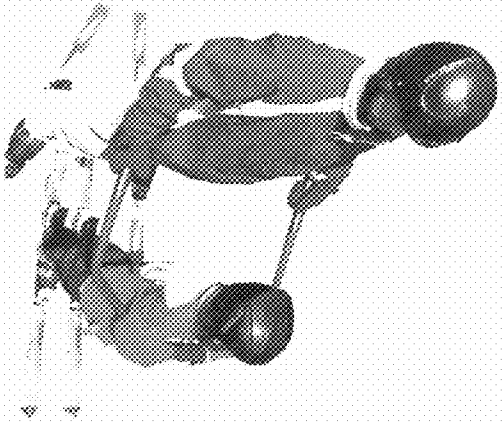
Figure 12:
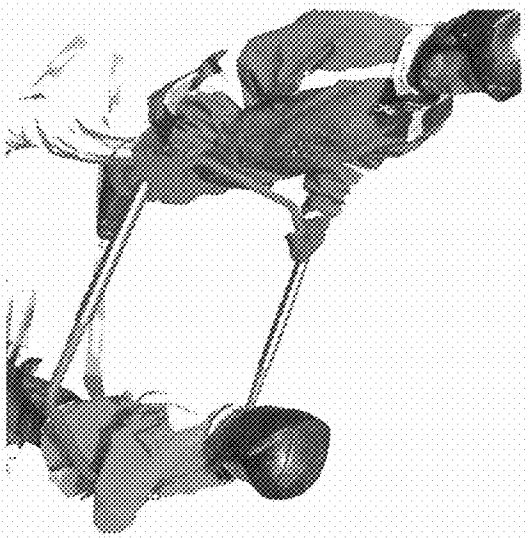

FIGS. 10-12 are similar to FIGS. 3-5 in illustrating use of the training hoop at different levels of instruction.

Figure 13:
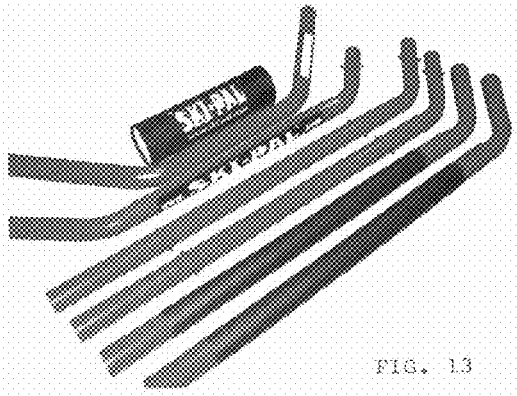

FIG. 13 is a fragmentary view of parts of the hoop disassembled

DETAILED DESCRIPTION

Figure 2:
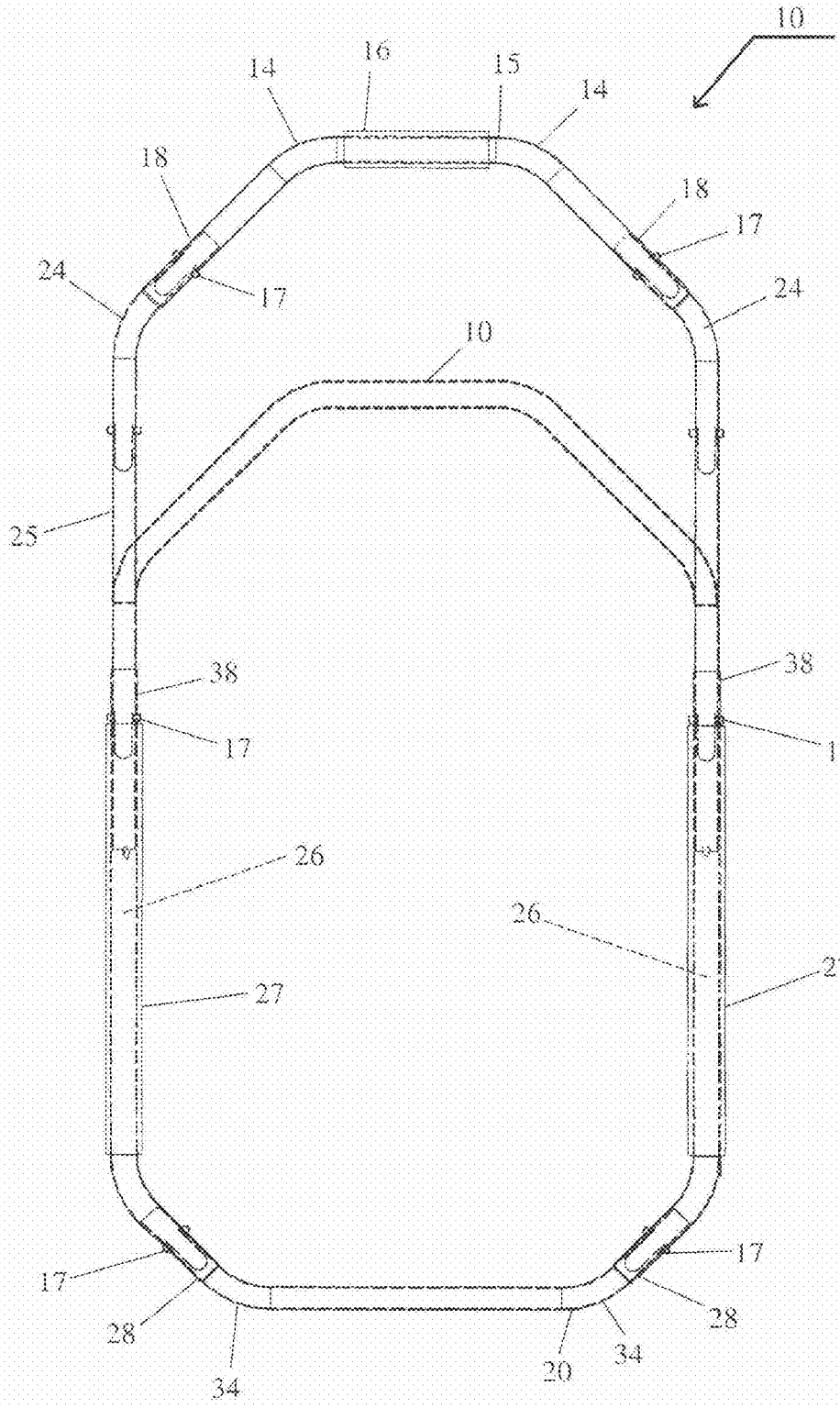
FIG. 2 is a plan view of a training hoop assembled from the parts shown in FIG. 1 and illustrating telescopically adjustable length alternatives.

Hoop 10, as shown assembled in FIG. 2, is preferably formed of lengths of tubing, which can be made of plastic, or preferably formed of metal, such as steel or aluminum. These tubing lengths preferably include a front tube 15, a rear tube 20, a pair of front side tubes 25, and a pair of rear side tubes 26. Front tube 15 preferably has a pad 16 arranged for the comfort of a pupil, and rear side tubes 26 preferably have hand grips 27 for use by an instructor.

Figure 1:
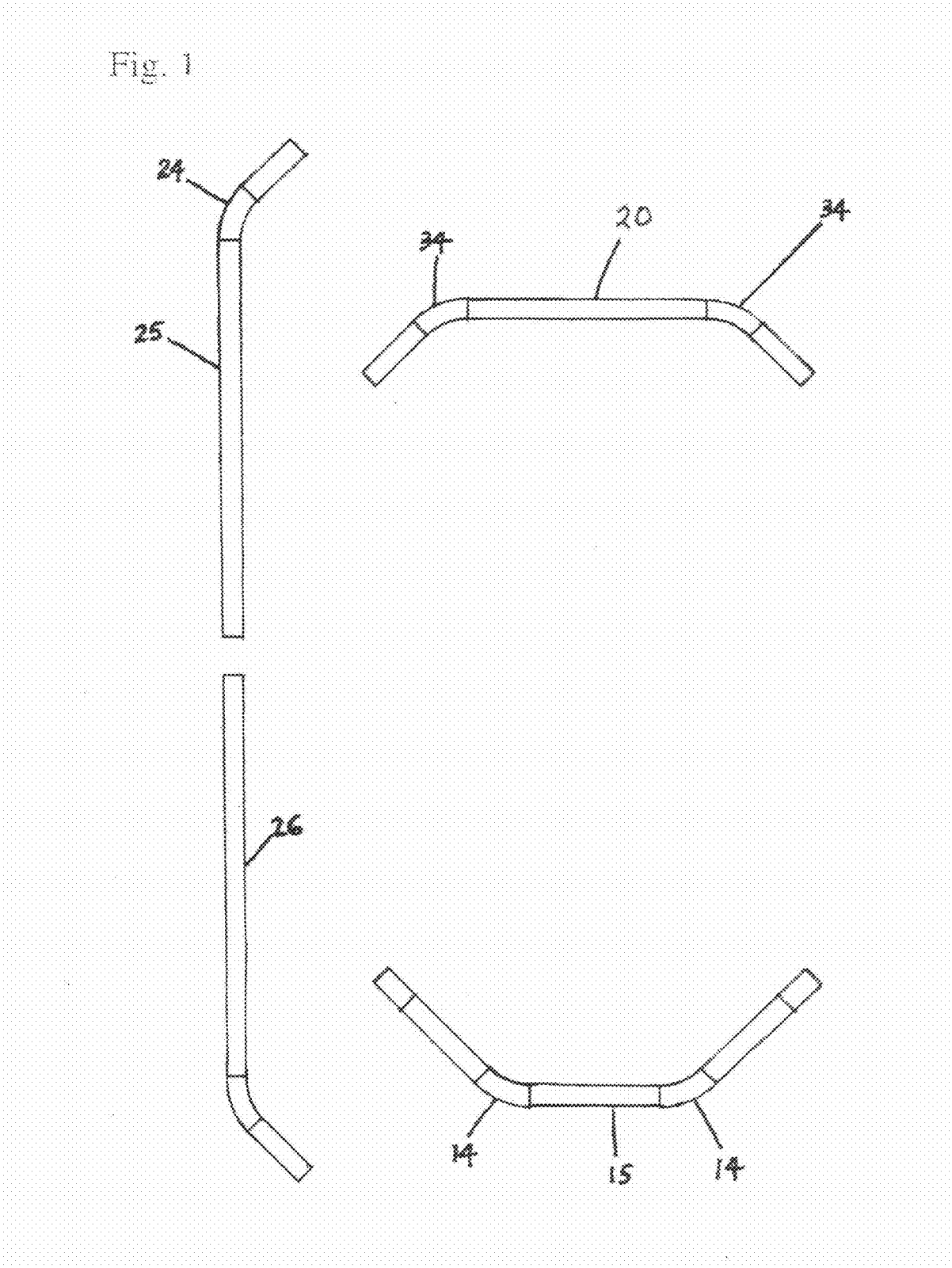
FIG. 1 is a plan view of the tubing parts used to assemble the inventive training hoop.

One of the virtues of oblong hoop 10 is that it knocks down to six compact pieces, as shown in FIG. 1. Side pieces 25 and 26 come in pairs, and fit together with front and rear pieces 15 and 20. Another virtue is that the oblong length of hoop 10 is adjustable to a short and a long length, as shown by the double headed arrow in FIG. 2.

The tubes forming the six pieces of hoop 10 are dimensioned to telescope together at their interconnections. Each of these interconnections is preferably latched by a push pin in one tube entering a hole in a connected tube. The telescopic adjustment for long and short hoops is also preferably set by push-pin and hole connections.

Apart from the telescopic joints between the front and rear side tubes 25 and 26, tube connections are arranged at corners of the hoops. This is done by forming joinable tubing ends with 45° bends. Pairs of the 45° bends are arranged at corners of the hoop so that the two 45° angle bends lead from straight side sections to perpendicular front and cross tubes. Having bends of no more than 45° on each tubing piece contributes to compactness of the knocked down hoop pieces, as illustrated in FIG. 13.

The corners of hoop 10 are preferably beveled by pairs of 45° bends on opposite sides of the tube junctions that are arranged in each corner. Each junction occurs where an end of one tube fits inside an end of another tube. This can be done by using tubes of different diameters, or by swagging tube ends so that one fits inside another at each junction. Front tube junctions 18 are arranged at front corners of hoop 10 and occur between front tube 15 and forward side tubes 25. In a similar way, rear tube 20 joins with each of the rear side tubes 26 at rear corner junctions 28 held together by push pins 17. Side junctions 38 between front side tubes 25 and rear side tubes 26 are preferably telescopically adjustable so that 2 pairs of spaced apart push pins 17 can interlock in either of the two illustrated positions for changing the length of oblong hoop 10 between the solid and broken line positions. Alternatively, a single pair of push pins 17 can interlock with spaced apart holes to adjust the hoop between long and short positions.

Junctions 18, 28, and 38 are preferably held together with push pins or snap buttons 17. These are well-known connectors that are spring biased to detent into a hole in a surrounding tube, as illustrated in the enlarged fragment of FIG. 9. Several variations of push pins or snap buttons exist, and alternative connectors to hold tube ends together are also available. Push pins 17 also allow the tubing pieces of hoop 10 to be disassembled into six pieces, four of which are illustrated in FIG. 1. (Front side tubes 25 and rear side tubes 26 are used in pairs to complete the six pieces needed.)

The tube pieces shown in FIG. 1 all include at least one bend, preferably of 45°. Front tube 15 has two bends 14 leading to front corner junctions 18. Front side tubes 25 each have a single bend 24 leading respectively to front corner junctions 18 where tubes 25 interconnect with tube 15.

In a similar way, rear tube 20 has a pair of bends 34 leading to rear corner junctions 28, and rear side tubes 26 each have a bend 44 leading to rear corner junctions 28. Such an arrangement allows the tubing pieces to fit together in each of the corner junctions while preserving the approximately rectangular shape of oblong hoop 10. Side junctions 38 can then be arranged in straight sections of tubes 25 and 26 so as to be telescopically adjustable as illustrated. This is preferably accomplished by sliding side tubes 25 and 26 together so that spaced pairs of push pins or holes can be variably interlocked to adjust the respectively longer or shorter lengths of hoop 10.

FIGS. 3, 4, and 5 show preferred ways of using hoop 10 as a training aid for a pupil 50 who is beginning to ski or skate. At the earliest stage of learning, when the pupil is just starting to ski or skate, both the pupil 50 and the instructor 60 are inside hoop 10, with the instructor holding hoop 10 and being positioned closely behind the pupil who occupies the forward region of hoop 10, as shown in FIG. 3. Front tube 15 preferably extends across the chest of the pupil and under the armpits of the pupil, and the first stage position gives the pupil excellent support and gives the instructor full control. The instructor's legs and skis or skates can straddle the pupil's legs and skis, and by skiing or skating slowly and controlling the position of the hoop, the instructor can give the pupil a feel for the skiing or skating process.

As the pupil 50 becomes a little more advanced, the instructor 60 can move to the rear region of hoop 10 in a second stage illustrated in FIG. 4. Here the instructor continues to hang onto the sides of hoop 10 while giving the pupil some support while allowing more freedom of movement. The oblong shape of hoop 10 with a narrowed front region adjacent front tube 15 provides close support for pupil 50 while also having a lateral width sufficient for movement of the instructor between the FIG. 3 and FIG. 4 positions. Hoop 10 can also be extended to lengthen its front-to-rear distance and provide more room for the instructor to move to the rear of the tube.

In a third stage, shown in FIG. 5, when a pupil has learned some of the fundamentals of skiing or skating, the instructor can move outside the hoop and be positioned at the rear of the hoop where the instructor's hold on the hoop can keep the pupil from running out of control, and can help guide the student into his turns. The preferred light weight and strength of hoop 10 facilitates movement of the instructor 60 between positions inside and outside of hoop 10.

In all these stages, hoop 10 is preferably strong enough and rugged enough that the pupil can be well supported and kept from harm while learning. Besides preventing any runaway accident, hoop 10 can help keep the pupil from falling while experiencing the movements that need to be learned for successful skiing, skating, or snowboarding.

After each skiing lesson, hoop 10 can be disassembled into six pieces of tubing that can be transported conveniently in a small and compact travel bag or box as shown in FIG. 7. Conversely, the tubes of hoop 10 can be reassembled simply by snap fitting them together when the time for another lesson arrives.

The training hoop described above can be adjusted for length with only a brief interruption in its use. By holding one end of the hoop down with a ski or foot, and releasing the side push pins, the other end can be raised to extend the longitudinal dimension of the hoop. The preferred push pin connectors readily unlatch to allow the spreading motion and then automatically snap into place in the new extended length, so that extending the hoop can be accomplished in a few seconds, without needing any disassembly or insertion of extra parts.

Reversing the process to make an extended hoop more compact is also simple and doable in a few seconds. A user merely releases the push pins holding the hoop in an extended position and then pushes one end of the hoop down toward the other until the push pins snap into new holes positioned at the shorter longitudinal dimension of the hoop. This rapid adjustability allows the hoop to be changed from long to short between successive runs without hardly interrupting the skiing.

FIG. 9 shows a version of the preferred spring loaded push pins 17 arranged on a tube 25 that is being telescopically inserted into tube 26. Holes, not shown, in tube 26 allow push pin 17 to expand upon reaching an assembled destination. Alternative push pins and snap locks are also available, and the preference is for readily actuated devices that automatically snap into latched positions.

FIG. 8 shows parts of the hoop 10 disassembled and juxtaposed near assembled positions. It also shows a pair of spaced apart push pins 17 on tubes 25, which can be telescopically inserted into tube 26, which has a single hole to receive either one of the push pins 17. This allows for tube 25 to be inserted to different depths into tube 26 to establish an extended hoop or a shortened hoop. Outward extension of the hoop is stopped when lower push pins 17 reach positioning holes that establish the maximum extended length of tube 25. Conversely, pushing tube parts together to make them more compact stops when push pin 17 at the shorter length of extension of tube 25 reaches the assembly holes in tube 26 and snaps into assembled position. As explained above, these adjustments are quick and convenient. An alternative to the separated pairs of push pins 17 on tubes 25, is a single set of push pins 17 latchable into separated holes in tubes 26.

The hoop can also be used for training activities other than skiing. These include snowboarding, ice skating or roller blading, roller skating and skateboarding. For snowboarding and skateboarding, the trainer and trainee preferably face each other on opposite sides of the training hoop, with each of them gripping a side of the hoop with both hands, as shown in FIG. 6. In this position, the trainee can avoid falling down or going too fast and can take some support from the trainer. At the same time, the trainer can direct the movement that the pair will take so that the trainee learns what different movements feel like and gradually adapts independently to these movements. For such training purposes, the hoop is preferably shortened to its compact length, since this is adequate and comfortable. The rigidity and strength of the hoop is advantageous in this type of use since it is strong enough to bear weight and considerable force without flexing or becoming loose. This offers security to the trainee to prevent falls, and also helps the trainer direct the trainee in the movements to be mastered.

Another use of the above-described training hoop can be a single-handed grip by both the trainee and the trainer. This is for more advanced training where the trainee is nearly ready for moving independently, but can rely on some security from having a grip on the training hoop. Hoop 10 is wide enough so that the instructor can get in and out of the hoop while in motion on the ski slopes without having to stop. It is also possible for the trainee to be positioned within the hoop as described above and for the trainer to follow either behind or alongside with a single handed grip on the hoop. The rigidity and strength of the hoop allows its use in all these ways, because in any configuration it is strong enough and rigid enough to bear the forces involved in helping hold the trainee up and helping the trainer direct the movement of the trainee. It is even possible for two trainers to assist a single trainee by holding onto opposite sides or ends of a hoop while a pupil stays inside the hoop.

The variety of uses for the training hoop is limited only by the imagination of the users. For example, it is possible for the trainer to ski backwards while holding and guiding the trainee within the training hoop. The trainee could also be outside the hoop and hanging onto the other end or side of the hoop while the trainer skis backwards.

It is also possible for a pair of skiers, snowboarders, skaters, etc. to move in tandem while confined within or hanging onto the hoop. This can add another dimension to the pleasure of moving together.

Hoop 10 can also be used for several forms of adaptive skiing and snow boarding. People who are visually impaired, developmentally delayed, autistic, or are single amputees or suffering from cerebral palsy can enjoy skiing or snow boarding when assisted and protected by a trainer guiding the hoop. This can be a way of giving the pleasure of skiing and snow boarding to people who otherwise might not be able to manage it.

What is claimed is:

1. A knock-down and adjustable training hoop for training a pupil to ski, snowboard, or skate, the hoop comprising:

the hoop being formed of six tubes sized so that end regions of the six tubes can telescope together into an assembled hoop; the end regions of the tubes having push pin and hole latch arrangements allowing the end regions to be pushed together into telescoping and latched joints during assembly and allowing a knock-down disassembly of the tubes upon release of the push pins holding the telescoped joints together; the six tubes including a pair of front side tubes and a pair of rear side tubes having straight regions telescoped together with push pin and hole latch arrangements adjusting the length of the assembled side tubes for long and short hoops; front end regions of the front side tubes having 45 degree bends, and rear end regions of the rear side tubes having 45.degree bends; a front cross tube and a rear cross tube each having a straight central region and 45 degree, bends at each opposite end region so that the end regions of the front and rear cross tubes telescopically connect respectively with the front side tubes and the rear side tubes in corner joints; each of the four corner joints being latched together with push pin and hole latch arrangements; all of the straight and bent end regions of the tubes lying in a single plane when assembled into a hoop; and the joints between the front and rear side tubes and the corner joints all being disassembleable by release of the push pin and hole latch arrangements to knock down the hoop into the six tubes so that straight and bent end regions of the tubes nest together for compact storage and transport; and the hoop enclosing a region that is empty to accommodate the pupil in the empty region while an instructor grips the hoop.

2. The training hoop of claim 1 wherein the front side tubes each have a pair of spaced apart push pins that latch into holes in the rear side pieces to adjust the hoop between long and short lengths.

3. A knock-down and adjustable training hoop for training a pupil to ski, snowboard, or skate, the hoop comprising: six tubes dimensioned to telescope together at four corner joints and at telescopically adjustable side joints; push pins arranged at end regions of the tubes to latch the end regions together at the four corner joints; a variable push pin and hole latch arrangement allowing telescopic adjustment of the side joints to form long and short hoop adjustments; release of the push pins allowing the corner joints and the side joints to be disassembled to knock down the hoop into the six tubes; the end regions of the tubes adjacent the corner joints having 45 degree bends allowing the six tubes to nest compactly together when knocked down; the side joints being adjustable for length by releasing the push pins and pushing a rear cross tube toward a front cross tube to adjust to a shorter hoop or by pulling the rear cross tube away from the front cross tube to adjust to a longer hoop; and the tubes and the bent ends of the tubes all lying in a single plane when the hoop is assembled; and the hoop enclosing a region that is empty to accommodate the pupil in the empty region while an instructor grips the hoop.

4. The training hoop of claim 3 wherein the front side tubes each have a pair of spaced apart push pins that latch into holes in the rear side pieces to adjust the hoop between long and short lengths.

5. A method of assembling, disassembling, and adjusting the knock down training hoop of claim 1, the method comprising:

assembling the six tubes into an oblong hoop by inserting an end region of each tube into an end region of another tube;

pushing the end regions together to latch the tubes together at the four corner joints;

assembling the side tubes of the hoop to telescope together into adjustable length positions;

pushing the side tubes together to reach a latched position for a short length of side tubes, and pulling the side tubes apart to reach a latched position for a longer length of side tubes; and disassembling the hoop by releasing the latched joints and separating the joints so that the six tubes nest together compactly for storage and transport.

6. The method of claim 5 including orienting the bent ends of the tubes so that straight and bent end regions of the tubes all lie in a plane as the tubes are assembled together at the four corner joints.

7. A method of assembling, disassembling, and adjusting the knock down training hoop of claim 3, the method comprising:

assembling the six tubes into an oblong hoop by inserting the end region of each tube into an end region of another tube;

pushing the end regions together to latch the tubes together at four corner joints;

assembling the side tubes of the hoop to telescope together into the long and short adjustable length positions;

pushing the side tubes together to reach a latched position for a short length of side tubes, and pulling the side tubes apart to reach a latched position for a longer length of side tubes; and disassembling the hoop by releasing the push pins and separating the joints so that the six tubes nest together compactly for storage and transport.

8. The method of claim 7 including orienting the bent ends of the tubes so that straight and bent end regions of the tubes all lie in a plane as the tubes are assembled together at the four corner joints.

* * * * *